US006564734B1

(12) United States Patent
Picker et al.

(10) Patent No.: US 6,564,734 B1
(45) Date of Patent: May 20, 2003

(54) METHOD FOR OPERATING A SEWING MACHINE FOR JOINING A FIRST PART OF A SEWN ARTICLE TO A SECOND PART OF A SEWN ARTICLE AND INTEGRATING EXCESS WIDTH AT THE SAME TIME

(75) Inventors: Arthur Picker, Steinhagen (DE); Karl-Heinz Lohmann, Bielefeld (DE); Ralf Kres, Bielefeld (DE)

(73) Assignee: Durkopp ADLer Aktiengesellschaft (DE)

( * ) Notice: Subject to any disclaimer, the term of this patent is extended or adjusted under 35 U.S.C. 154(b) by 0 days.

(21) Appl. No.: 09/959,713

(22) PCT Filed: Apr. 8, 2000

(86) PCT No.: PCT/EP00/03151

§ 371 (c)(1),
(2), (4) Date: Jan. 22, 2002

(87) PCT Pub. No.: WO00/66825

PCT Pub. Date: Nov. 9, 2000

(30) Foreign Application Priority Data

May 4, 1999 (DE) ..... 199 20 350

(51) Int. Cl.[7] ..... D05B 19/16; D05B 27/08

(52) U.S. Cl. ..... 112/475.05; 112/313; 112/470.04

(58) Field of Search ..... 112/475.05, 475.01, 112/475.04, 313, 312, 470.04, 470.05, 470.31, 470.32, 132

(56) References Cited

U.S. PATENT DOCUMENTS 5,249,540 A * 10/1993 Sielemann ..... 112/304
6,178,904 B1 * 1/2001 Bastian et al. ..... 112/475.05

OTHER PUBLICATIONS

International Search Report for Corresponding PCT case PCT/EP00/03151.

* cited by examiner

*Primary Examiner*—Peter Nerbun
(74) *Attorney, Agent, or Firm*—Robert F. I. Conte; Barnes & Thornburg

(57) ABSTRACT

In a method of operating a sewing machine for joining a jacket part (38) to a sleeve part (39), a sewing machine is employed, which has an operating and control unit. The desired stitch length and the length (la1 to ld1) of sections (a1 to d1) of the jacket part (38) and the length (la2 to ld2) of the sections (a2 to d2) of the sleeve part (39) that are allocated to the sections (a1 to d1) are fed into the operating and control unit. The required control pulses for the necessary feed drives are determined therefrom for each section (a1/a2 to d1/d2).

3 Claims, 3 Drawing Sheets

| SEAM SECTION | JACKET PART | SLEEVE PART | KW | GR |
|---|---|---|---|---|
| a1 / a2 | 100 | 105 | 5,5 | 4,5 |
| b1 / b2 | 95 | 100 | 3 | 2 |
| c1 / c2 | 60 | 65 | 4 | 0 |
| d1 / d2 | 25 | 25 | 0 | 0 |
| | | | | |

METHOD FOR OPERATING A SEWING MACHINE FOR JOINING A FIRST PART OF A SEWN ARTICLE TO A SECOND PART OF A SEWN ARTICLE AND INTEGRATING EXCESS WIDTH AT THE SAME TIME

REFERENCE TO RELATED APPLICATIONS

The present application is the national stage under 35 U.S.C. §371 of international application PCT/EP00/03151, filed Apr. 8, 2000 which designated the United States, and which application was not published in the English language.

The invention relates to a method according to the preamble of claim 1.

BACKGROUND OF THE INVENTION

A method of the generic type is known from EP 0 124 211 B2. In this case, a workpiece is shifted between two adjacent stitches by a greater length than another workpiece. To this end, control data of a sequence or a profile of varying feeds and advances is given by a control unit in dependence on a count of a stitch counter. A similar method is known from the PFAFF leaflet 3834-4/11.

DE 34 90 775 C2 (corresponding to WO 86/02673) teaches a fundamentally similar apparatus.

BRIEF SUMMARY OF THE INVENTION

It is an object of the invention to embody a method of the generic type such that programming the sewing machine can be carried out very easily and without too much time needed.

According to the invention, this object is attained by the features of the characterizing part of claim 1. The gist of the invention resides in that the lengths of sections that have been determined by the modeler are directly fed in. No stitch counts are fed in for certain stitch lengths, but the desired stitch length in addition to the length of the individual sections. Based thereon, the computer determines gathering values, which are displayed on the display unit of the operating and control system, thus being visible and verifiable for the operator. If necessary, the gathering values may be modified by the operator if the sewing pattern does not correspond to the predetermined values. The computer automatically considers such a modification of the gathering values in correspondingly triggering the feeder-actuating stepper motors. A modification of the desired stitch length does not affect the values determined for the individual sections. Correspondingly, the operator is free to suit the stitch length to fabric quality or to select them in accordance with fabric quality. Corresponding to the given stitch length, the computer automatically determines the triggering data for the stepper motors.

The input, according to claim 2, of graduation values given by the modeler for the sections of a basic garment size enables values to be prepared automatically for the workpiece sections of other garment sizes, there being no need for any time-consuming input of values for workpieces of other garment sizes.

As a result of the input of so-called fabric correction values according to claim 3, the effect of the advance motion of the respective feeder on the workpiece it transports is taken into account. This is important in particular for very smooth fabrics, in which case slip will occur between the fabrics and the feeder. It may be equally important for very rigid or thick fabrics.

BRIEF DESCRIPTION OF THE SEVERAL VIEWS OF THE DRAWINGS

Details of the invention will become apparent from the ensuing description of an exemplary embodiment, taken in conjunction with the drawing, in which.

DETAILED DESCRIPTION OF THE INVENTION

Figure 1:
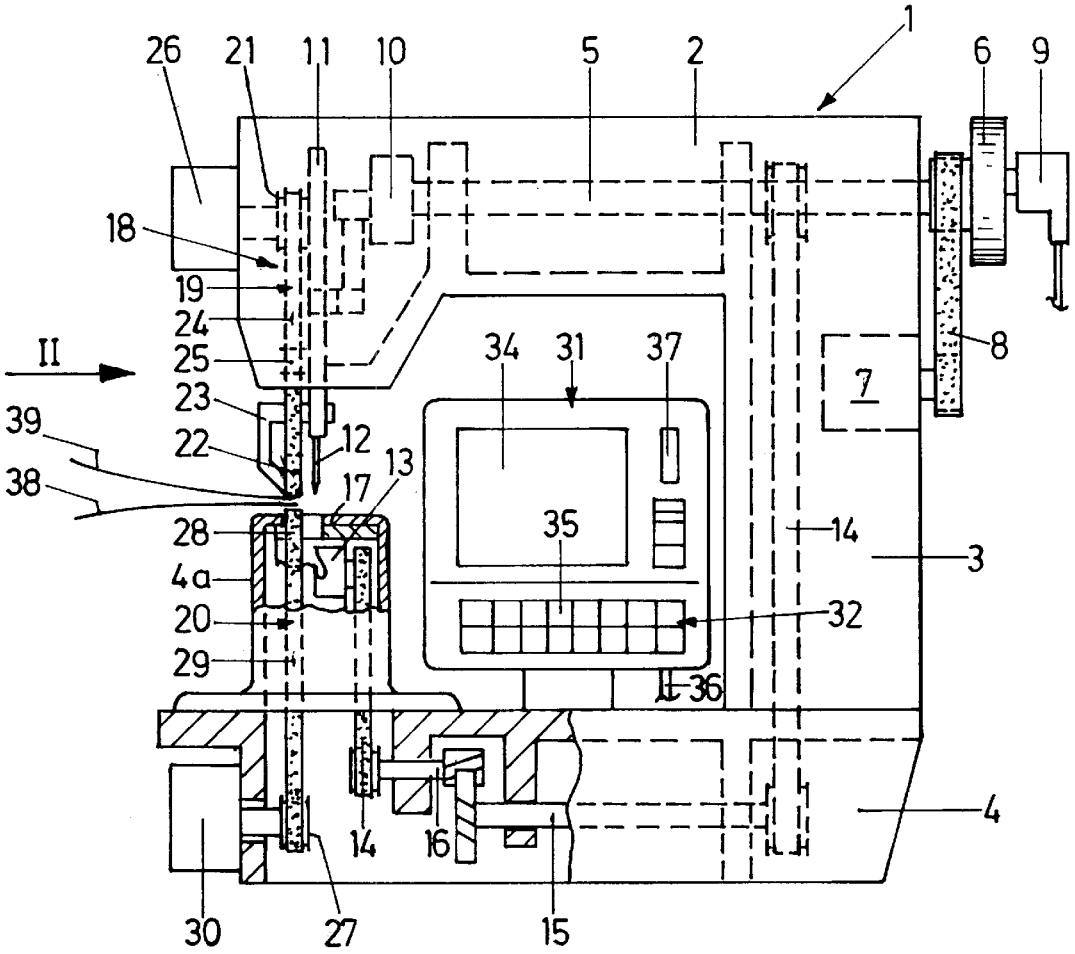
FIG. 1 is a strongly diagrammatic illustration of a lateral view of a sewing machine that is suitable for the method according to the invention.

FIG. 1 shows a sewing machine 1 which conventionally comprises an upper arm 2, a vertical standard 3 and a lower housing that is customarily called the base plate 4. The base plate 4 has an upward post 4*a*, which is why a sewing machine of this type is called a post-bed sewing machine. An arm shaft 5 is rotatably mounted in the arm 2; on its end that projects from the arm 2, it is provided with a balance wheel 6. Actuation of the arm shaft 5 and thus of the substantial basic units of the sewing machine 1 takes place by means of an electric driving motor 7 via a belt drive 8. In the vicinity of the balance wheel 6, an incremental transmitter, which is usually called a position transmitter 9, is mounted on the arm shaft 5.

Connected to the arm shaft 5 on the end opposite the balance wheel 6 is a crank drive 10, by means of which a needle bar 11 that is vertically mounted in the arm 2 is drivable to reciprocate up and down. At its lower end, the needle bar 11 is provided with a needle 12. Below the needle bar 11, a two-thread lock stitch hook 13 is rotatably drivably mounted in the base plate 4. Rotary actuation is derived from the arm shaft 5 by way of a belt drive 14 and shafts 15, 16 so that synchronous motions of the needle 12 and hook 13 are obtained, which combine to form the sewing implements. Of course, the hook 13 rotates at twice the speed of the arm shaft 5. The needle thread is customarily supplied to the needle 12. The hook 13 is customarily equipped with a hook thread supply. The workpieces 38, 39 that are to be sewn up, are led over a stitch plate 17, which finishes the upper side of the base plate 4 and through which the needle 12 reaches into the vicinity of the hook 13.

Figure 2:
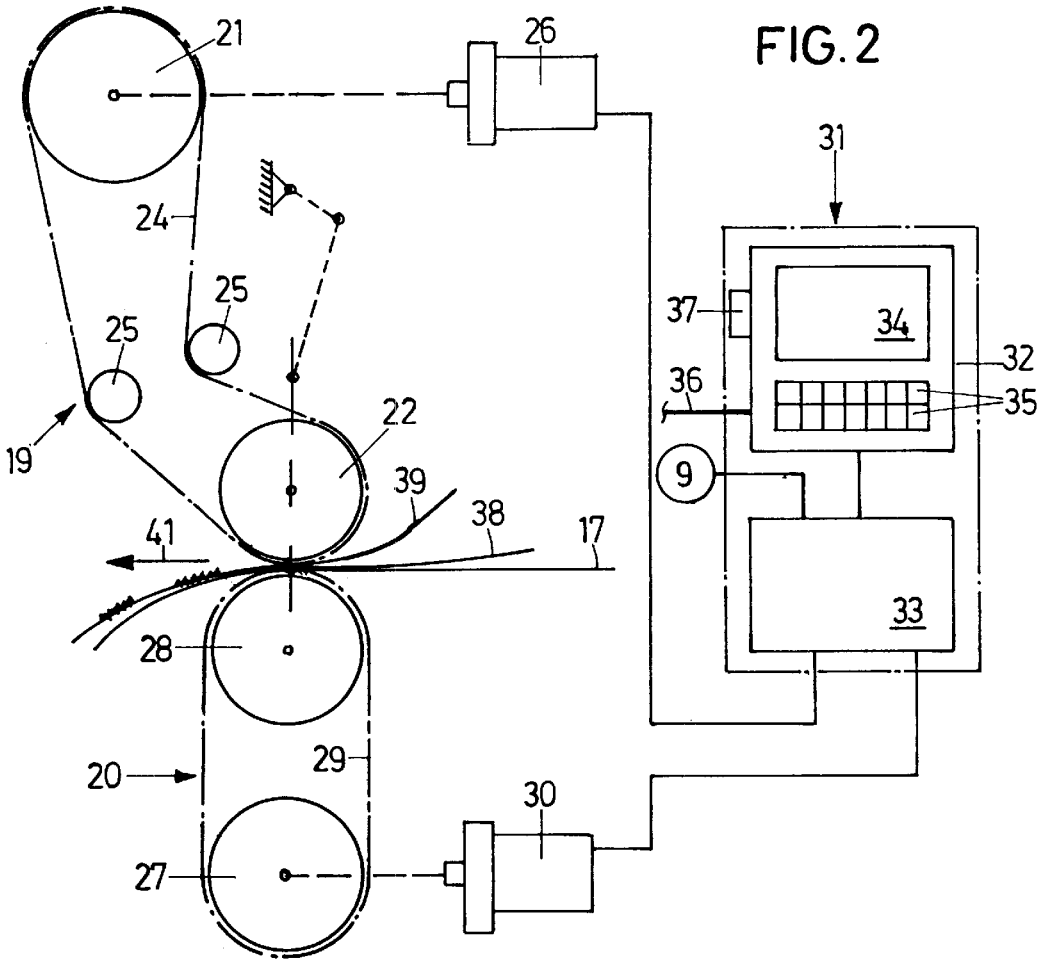
FIG. 2 is a diagrammatic view of the fabric feeder arrangement of the sewing machine in accordance with the arrow II of FIG. 1.

A fabric feeder arrangement 18 is provided by the side of the needle bar 11, having an upper feeder 19 and a lower feeder 20, which are diagrammatically shown in FIG. 2.

The upper feeder 19 comprises a driving pulley 21 which is lodged in the arm 2 and which a lower deflection pulley 22 is allocated to; the deflection pulley 22 is flexibly mounted on the arm 2 by way of a lever 23. An upper feed belt 24 is led along the driving pulley 21 and the deflection pulley 22 and additionally along deflection rolls 25. The driving pulley 21 is actuated by means of an upper stepper motor 26 that is mounted in the arm 2.

The lower feeder 20 comprises a driving pulley 27 lodged in the base plate 4, with a deflection pulley 28 allocated thereto that is equally lodged in the base plate 4. A lower feed belt 29 is led over the driving pulley 27 and the deflection pulley 28. Actuation of the driving pulley 27 takes place by means of a lower stepper motor 30 that is disposed in the base plate 4. The feed belts 24 and 29 adjoin each other approximately in the plane of the stitch plate 17. A fabric feeder arrangement of this type is known for instance from DE 90 11 178 U (corresponding to U.S. Pat. No. 5,249,540). Instead of the fabric feeder arrangement shown, an arrangement may be used in which two feed wheels are in direct engagement with the workpieces 38, 39 that are to be sewn up. Fabric feeder arrangements of this type are known for instance from DE 35 46 541 C2 (corresponding to U.S. Pat. No. 4,671,197).

An operating and control unit 31 is mounted on the sewing machine 1, comprising an operating equipment 32 and a control equipment 33, which are interconnected electrically. The operating equipment 32 comprises a display unit 34 and an input keyboard 35. A data line 36 is provided for the supply of data for instance from a modeler's PC. Furthermore, data may be fed in via a RAM memory card 37.

The control equipment 33 comprises a computer (not shown) and an input that comes from the operating equipment 32 and another input coming from the position transmitter 9.

Figure 3:
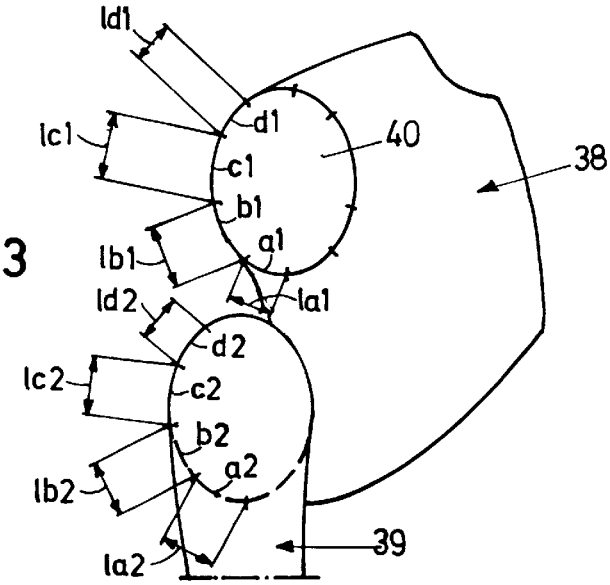
FIG. 3 is a diagrammatic illustration of a sleeve part that is to be sewn to a jacket part.

As seen in FIG. 3, two workpieces 38, 39 are to be joined, the first workpiece 38 being a jacket part with an armhole 40 and the second workpiece 39 being a sleeve part. Around the armhole 40, the first workpiece 38 is divided into sections, four sections of which are designated by a1 to d1 by way of example, with the number of sections being distinctly higher in practice. Sections a2 to d2, which are allocated to the sections a1 to d1, are provided on the second workpiece 39, the second workpiece 39 and the first workpiece 38 being sewn up in such a way that the associated sections a1–a2 to d1–d2 are sewn up. The individual sections a1 to d1 have a length la1 to ld1. The sections a2 to d2 have a length la2 to 1d2. The excess widths resulting from the difference of the lengths la2 and la1 must be arranged in a uniform gathering when the individual sections a1 and a2 to d1 and d2 are sewn up.

Figure 4:
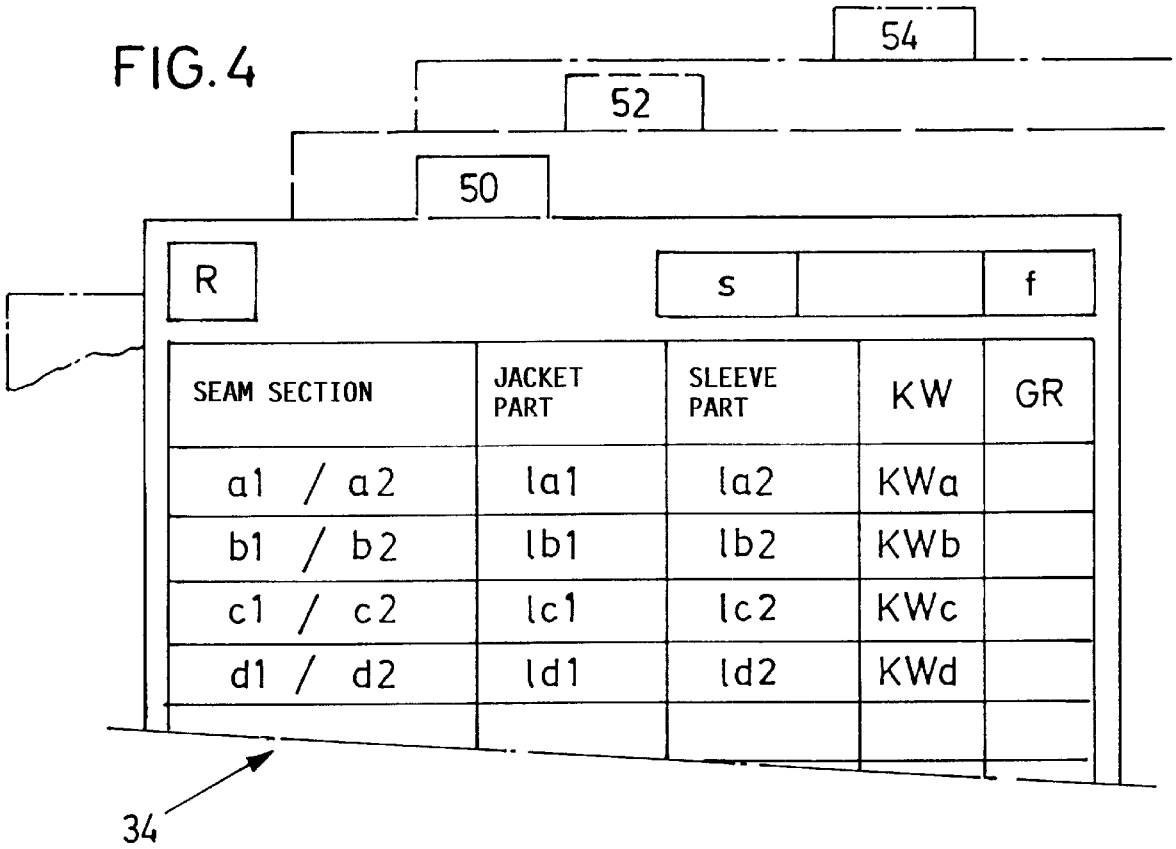
FIG. 4 is a diagrammatic view of a data record in an abstracted illustration that appears on the display of the operating and control unit.
Figure 5:
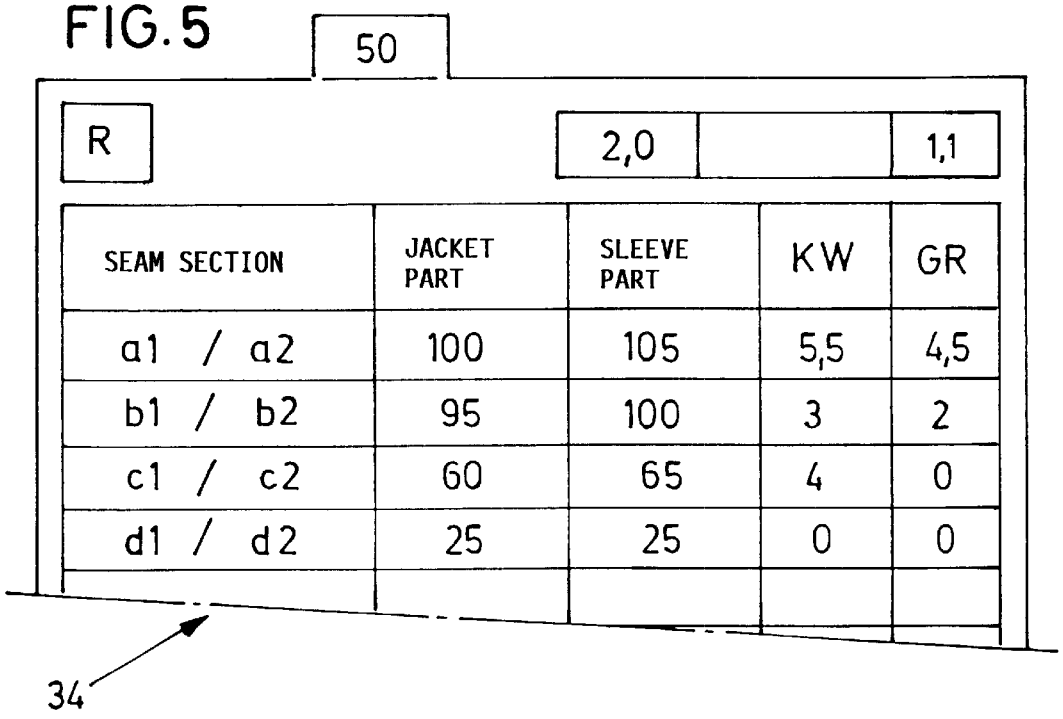
FIG. 5 is a concrete example of a data record appearing on the display.

As seen in FIGS. 4 and 5, the lengths la1, la2 etc. of the seam sections a1/a2, b1/b2 etc. in millimeters are fed in—as mentioned—via the data line 36 from the modeler's PC and/or via the RAM memory card 37 and/or via the input keyboard 35. In this case, FIG. 4 lists the general designations and FIG. 5 the numerical data of an exemplary embodiment. The input involves a basic garment size 50. From the lengths la1–la2, which are allocated to each other, the computer of the operating and control unit 31 automatically determines the associated gathering value KW. This gathering value KW is a non-dimensional characteristic number ranging between 0.0 and 15.0 in steps of 0.5. Allocated to each characteristic number is a feed increase value [mm], by which the upper feeder 19 must additionally transport the second workpiece 39, namely the sleeve part, as opposed to the lower feeder 20 which transports the workpiece 38. This gathering value KW is related to a basic stitch length s that corresponds to the advance of the first workpiece 38.

Furthermore, a so-called graduation value GR is fed in. Such a graduation value specifies a length [mm] by which the length la1 to Id1 of the section a1 to d1 of the armhole 40 increases or decreases from one garment size to the next greater or smaller garment size. The graduation value gives the section increases from the basic size 50 to the next garment size 52, 54 etc. In this way, it is possible, based on the graduation values, to compute the lengths la1 to Id1 on the one hand and correspondingly la2 to 1d2 on the other for further garment sizes, such as 46, 48, 52, 54, 58, 60, 62. Upon preparation of a model, the graduation value GR is determined and given by the modeler, based on the pattern. For optically identical gatherings of sewn up workpieces 38, 39 to be obtained along identical sections a2 to d2 of varying garment sizes, the associated sections a1 and a2 etc. are enlarged proportionally. After input of all the garment-size-50 graduation values GR given for the individual sections a1/a2 etc., the computer automatically computes all the remaining sections la1, la2 etc. for all the garment sizes involved in a sewing job.

Furthermore, the desired stitch length s [mm] is fed in, by which the workpieces 38, 39 are to be sewn up. In dependence on the lengths la1 to Id1 and the fed-in stitch length s and in consideration of further machine-specific parameters, the computer calculates the triggering values for the stepper motors 26, 30 and the number of stitches required for each section a1 to d1. The machine-specific parameters take into account that the sewing machine 1 is not equipped with a needle 12 that co-vibrates in the feed direction 41, but only has a needle 12 of reciprocating up and down motion so that the feeders 19 and 20 may be actuated only when the needle 12 does not stitch into the workpieces 38, 39. The feeders 19, 20 may only be actuated in the case of a certain area of infinitesimal rotation of the arm shaft 5. The unit 31 receives corresponding information from the position transmitter 9, from which it also receives a signal for each stitch that is made so that stitch counting takes place for each section a1 to d1.

In addition, a so-called fabric correction value f can be fed in as a non-dimensional figure, by means of which to consider the effect of the feed motion of the feeders 19, 20 on the advance of the workpieces 38, 39. In the case of a very smooth fabric for instance, slip will occur between the respective workpiece 38 and 39 and the corresponding feeder 19 and 20. By means of this fabric correction value, the feed per stitch of the feeders 19, 20 is as a rule modified in order for the desired stitch length to be obtained. The fabric correction value ranges between 1.0 and 1.2.

The subsequent sewing job then takes place fully automatically after the sewing machine has been set into operation, in which case, once the first section a1/a2 has been sewn, transition to the values given and determined for the sewing job of the second section b1/b2 takes place automatically.

What is claimed is:

1. A method of operating a sewing machine (1) for joining a first workpiece (38), in particular a jacket part with an armhole (40), to a second workpiece (39), in particular a sleeve part, wherein the sewing machine (1) comprises a needle bar (11) drivable to reciprocate up and down and having a needle (12);

a first feeder (20) with a first drive (30) for advancing the first workpiece (38);

a second feeder (19) with a second drive (26) for advancing the second workpiece (39);

an operating and control unit (31) for triggering the first drive (30) and the second drive (26);

an input unit for the operating and control unit (31); and a position transmitter (9) for the generation of signals that represent the position of the needle (12) and for the transmission thereof to the operating and control unit (31);

wherein, for incorporation of excess width of the second workpiece (39) relative to the first workpiece (38), the advance of the second feeder (19) exceeds a given advance of the first feeder (20);

wherein joining the first workpiece (38) to the second workpiece (39) takes place along associated sections (a1/a2 to d1/d2) of varying lengths (la1/la2 to Id1/ld2); and wherein the sewing operation is carried out; characterized by inputting the desired stitch length (s) into the operating and control unit (31); inputting the length (la1 to Id1) of sections (a1 to d1) of the first workpiece (38) into the operating and control unit (31);

inputting the length (la2 to ld2) of the sections (a2 to d2) of the second workpiece (39) that are allocated to the sections (a1 to d1) of the first workpiece (38) into the operating and control unit (31);

determining a number of control pulses, which is required for each section (a1/a2 to d1/d2), for the first drive in the form of a stepper motor (30);

determining a number of pulses, which is required for each section (a1/a2 to d1/d2) to be sewn, for rotary actuation of the second drive, in the form of a stepper motor (26), of the second feeder (19);

determining the number of stitches to be sewn, which is required for each section (a1 to d1) of the first workpiece (38), from the length (la1 to ld1) of the sections (a1 to d1) and the fed-in stitch length (s); and comparing the number of stitches made with a stitch count performed by the position transmitter (9).

2. A method according to claim 1, characterized by inputting graduation values (GR) for computation of the length (la1/la2 to ld1/ld2) of associated sections (a1/a2 to d1/d2) of associated first workpieces (38) and second workpieces (39) of varying garment sizes.

3. A method according to claim 1, characterized by inputting a fabric correction value for consideration of the effect of the advance motion of at least one feeder (19, 20) on the transported workpiece (38, 39).

* * * * *